United States Patent [19]

Caplat

[11] 4,027,846

[45] June 7, 1977

[54] PANEL FOR CASTING CONCRETE

[75] Inventor: Sylvain Caplat, Le-Blanc-Mesnil, France

[73] Assignee: Societe Les Coffrages Madernes, Paris, France

[22] Filed: Dec. 31, 1975

[21] Appl. No.: 645,907

Related U.S. Application Data

[63] Continuation of Ser. No. 318,034, Dec. 26, 1972, abandoned.

[30] Foreign Application Priority Data

Dec. 28, 1971 France ..... 71.47090

[52] U.S. Cl. ..... 249/189; 52/309.5; 52/309.13; 249/207

[51] Int. Cl.[2] ..... E04G 9/00; E04G 17/00; E04C 2/32

[58] Field of Search ..... 249/45, 10, 189, 188, 249/210, 207; 52/223, 309, 615, 618, 743

[56] References Cited

UNITED STATES PATENTS

| | | | |
|---|---|---|---|
| 2,761,191 | 9/1956 | Anderson | 249/45 X |
| 2,963,763 | 12/1960 | Le Cluyse | 249/189 X |
| 3,154,832 | 11/1964 | Weidner | 249/10 |

FOREIGN PATENTS OR APPLICATIONS

| | | | |
|---|---|---|---|
| 714,997 | 8/1965 | Canada | 249/189 |

*Primary Examiner*—Francis S. Husar
*Assistant Examiner*—John S. Brown

[57] ABSTRACT

A panel for casting concrete comprising a front casting plate having a flat front surface constituting a support surface for cast concrete and a rear plate spaced from the front plate. A layer of expanded plastic foam material such as polyurethane foam of high density is cast, in situ, between the plates and effects joinder of the plates with the foam layer to form an assembled panel which behaves as a beam and has high resistance to bending and shear stresses.

7 Claims, 7 Drawing Figures

PANEL FOR CASTING CONCRETE

CROSS-RELATED APPLICATION

This application is a continuation in part of Ser. No. 318,034 filed Dec. 26, 1972 and now abandoned.

FIELD OF THE INVENTION

The present invention relates to a form or panel for the casting of concrete.

BACKGROUND AND SUMMARY OF THE INVENTION

An object of the invention is to provide a new type of form leading to self-heating of the concrete and whose fabrication is much simpler, much more rapid and more economical and whose operations are easier than those of conventional forms which necessarily include a rigid and heavy framework to resist, without deformation, the substantial pressure of the concrete at the time of casting.

To succeed in the results, the invention proposes a form comprising:

a casting wall of sheet steel;

a rear wall also of sheet steel, the said casting wall facing the rear wall and being spaced therefrom; and a layer of expanded rigid polyurethane foam of high density molded in situ between the said walls and which achieves the connection between the said walls, the mechanical properties being such that the assembly of the form behaves under the force of the concrete as a beam and as a consequence:

the layer of polyurethane must have a sufficient rigidity in order to prevent relative displacement of the two walls and to resist shear-tensile forces, and for this purpose it is expanded at least to 200 kg/m$^3$;

the steel casting wall must have a thickness of at least 2.5 mm to resist the tensile forces;

the steel rear wall must have a thickness of at least 2.5 mm to resist the compression forces; and the adherence of the polyurethane layer with the said walls must have mechanical properties at least equal to that of said layer, i.e. it must be able to resist shear-tension forces.

An adherence presenting such properties can be advantageously obtained in the above noted manner by reason of the molding, in situ, of the polyurethane between the two plates due to the adherence properties of the polyurethane after polymerization.

Of course, it is possible to increase the adherence by coating the interior surfaces of the two walls before the molding with a primary adhesive.

The panels according to the invention are generally mounted at regular intervals on vertical posts of a conventional framework. Although these posts are formed as profiled steel members and despite the utilization of props or other supports, the subject, at the time of casting of the concrete, to flexure forces which according to the height of the posts can be translated at their upper portion to a deflection of the order of 0.5 cm.

Furthermore, despite its rigidity and its behavior as a conventional beam under the pressure of the concrete, the panel itself is subjected to a flexure in the space between two consecutive posts, to produce a bending deflection which can reach 0.15 cm. As a consequence, the molded face of the concrete article will not be perfectly planar.

A further object of the invention is to eliminate these disadvantages. For this purpose, the invention contemplates a construction in which the casting wall of the panel is not planar but is initially shaped such that when the panel is subjected to the pressure of the concrete, the deformations of the panel and that of the framework will be compensated to obtain a cast wall which is exactly planar.

According to the invention, the rear wall can be planar and come into contact over its entire height with the posts of the framework. The rear wall can also be reinforced by a succession of horizontal parallel folds at spaced intervals which decrease from top to bottom to take into account the pressure gradient of the concrete. This embodiment permits utilization of expanded polyurethanes of lower densities, for example, of the order of 100 kg/m$^3$.

It is to be noted that in all cases the panel according to the invention presents the advantage of possessing a very low thermal conductivity, notably because there is no thermal conduction path between the walls. This thermal insulating property permits obtaining a self-heating of the concrete by the substantial magnitude of heat generated during the curing thereof, and this accelerates the curing and permits a very rapid setting of the concrete.

Several embodiments of the invention will be described hereafter by way of non-limitative example with reference to the attached drawings.

BRIEF DESCRIPTION OF THE DRAWING

FIG. 4 is a vertical sectional view of a second embodiment of the panel of the invention.

DETAILED DESCRIPTION

Figure 1:
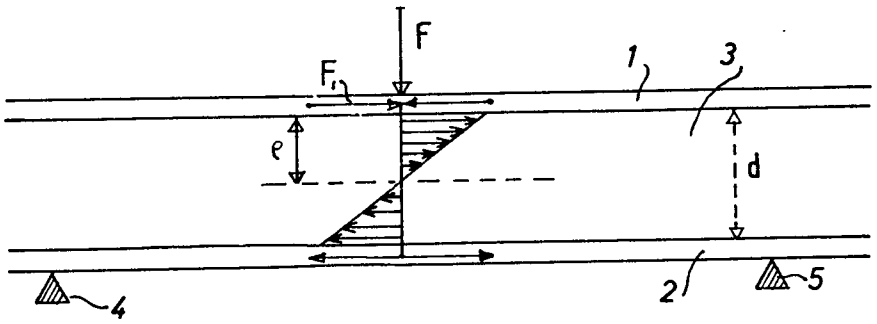
FIG. 1 is a schematic section of a panel according to the invention showing the principle of its behavior as a beam.

With reference to FIG. 1, the panel comprises a front casting wall 1 and a rear wall 2 between which is cast, in situ, a layer of rigid foam 3 of expanded polyurethane. The panel rests on two fixed supports 4 and 5.

According to the invention, the panel behaves as a beam, that is to say:

1. the two walls 1,2 of steel sheet are parallel at rest and also when a force F is applied which produces bending of the beam, 2. the layer of polyurethane foam 3 i.e. the core of the beam, must be sufficiently rigid in order to prevent relative displacement of the walls 1 and 2 under the force $F_1$ ($F_1=M_f/d$ wherein $M_f$ is the bending moment at the center of the beam and $d$ is the distance between the two walls), 3. the core 3 must have shear-tensile properties capable of resisting the force $F_1$, 4. the adherence of the core 3 to the sheets 1 and 2 must have strength properties at least equal to that of the core, i.e., a shear-tensile strength capable of resisting the force $F_1$, 5. the sheet 2 is subjected to tension by force $F_1$,
6. the sheet 1 is subjected to compression by force $F_1$,
7. the core 3 prevents buckling of the sheet 1 under the compression force $F_1$.

By way of example, it is known that the pressure of the concrete applied to a panel when poured in place and vibrated is equal to 6,000 kg/m². In the case where the panel is supported on posts spaced apart by a distance of 1 meter, the bending moment $M_f$ is equal to:

$$M_f = (PL/8) = (6{,}000 \times 1{,}000)/8 = 750{,}000 \text{ kg-mm}$$

In the case where the panel has a layer 3 of polyurethane foam of a thickness of 37.50mm (this thickness corresponds to a maximum economical criteria) the tangential component of the force F ($F_1$ tangential) is thus equal to:

$$F_1 \text{ tangential} = (750{,}000/37.5 = 20{,}000 \text{ kg}$$

For a stressed foam surface of 1m² or 10,000cm² the stress of the core 3 is 20,000/10,000 = 2kg/cm². If the steel sheets 1 and 2 are 3mm. in thickness, the stress of the sheets 1 and 2 is thus equal to 20,000 kg/1000mm × 3mm = 7kg/mm².

Mechanical Properties Of Polyurethane (rigid foam)

| Density in Kg/m³ | tensile strength kg/cm² | Compressive strength kg/cm² | Modulus of elasticity Kg/cm² |
|---|---|---|---|
| 50 | 1.4 | 215 | $10^2$ |
| 100 | 5 | 9 | $4 \times 10^2$ |
| 150 | 7 | 17 | $7.5 \times 10^3$ |
| 200 | 9 | 30 | $10^3$ |
| 300 | 15 | 70 | $2 \times 10^3$ |

It is found that to meet the conditions of 3, it is suitable to employ a foam of a density of 200 kg/m³ which gives a factor of safety of:

$$(\text{tensile strength})/F_1 = (9/2) = 4.5$$

Furthermore, to meet the relative conditions at the walls 1 and 2 these should be made of steel sheets of a minumum thickness of 2.5mm.

Figure 2:
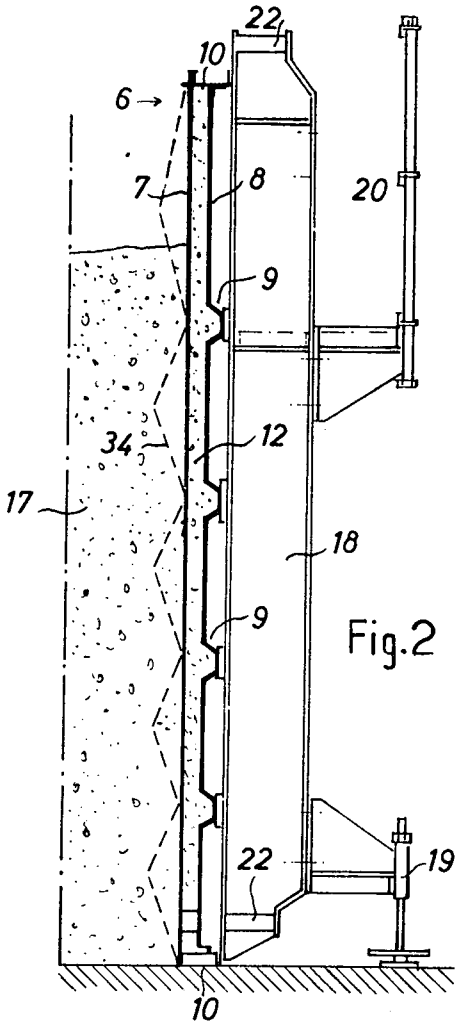
FIG. 2 is a vertical sectional view of casting apparatus showing a first embodiment of a panel according to the invention.
Figure 3:
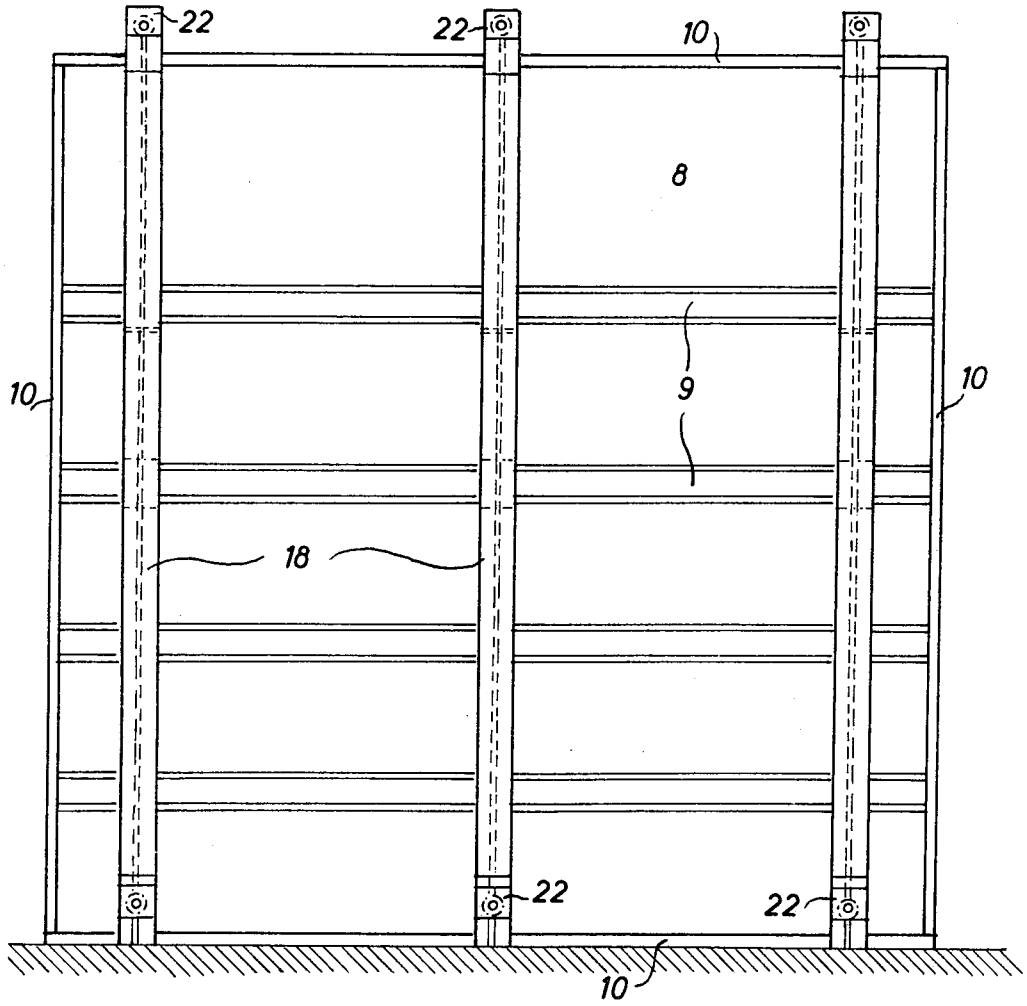
FIG. 3 is a rear elevational view of the apparatus of FIG. 2.

According to the embodiment of the invention illustrated in FIGS. 2 and 3, the panel 6 comprises a planar front casting wall 7, for example, of about 3mm thickness, and a rear wall 8 having parallel, transverse reinforcement folds 9. In order to permit assembly of one panel to the next, edge members 10 are welded all around the periphery of the panel to the two sheets 7 and 8 which embed between them the layer 12 of polyurethane foam.

To resist the pressure of the concrete 17, the panel is supported on the posts 18 of a conventional framework having means 19 for regulating the vertical position thereof together with the panel. A foot bridge 20 is provided on the framework. The panels are connected to the framework by means of conventional bolts (not shown) engaged in holes 22 in the posts 18 and in the panel 6.

The folds 9 on the rear wall are tapered in a direction away from the front wall and have rear bearing surfaces which rest on plates or other suitable means on the support frame for contacting the rear bearing surfaces.

Figures 5, 6:
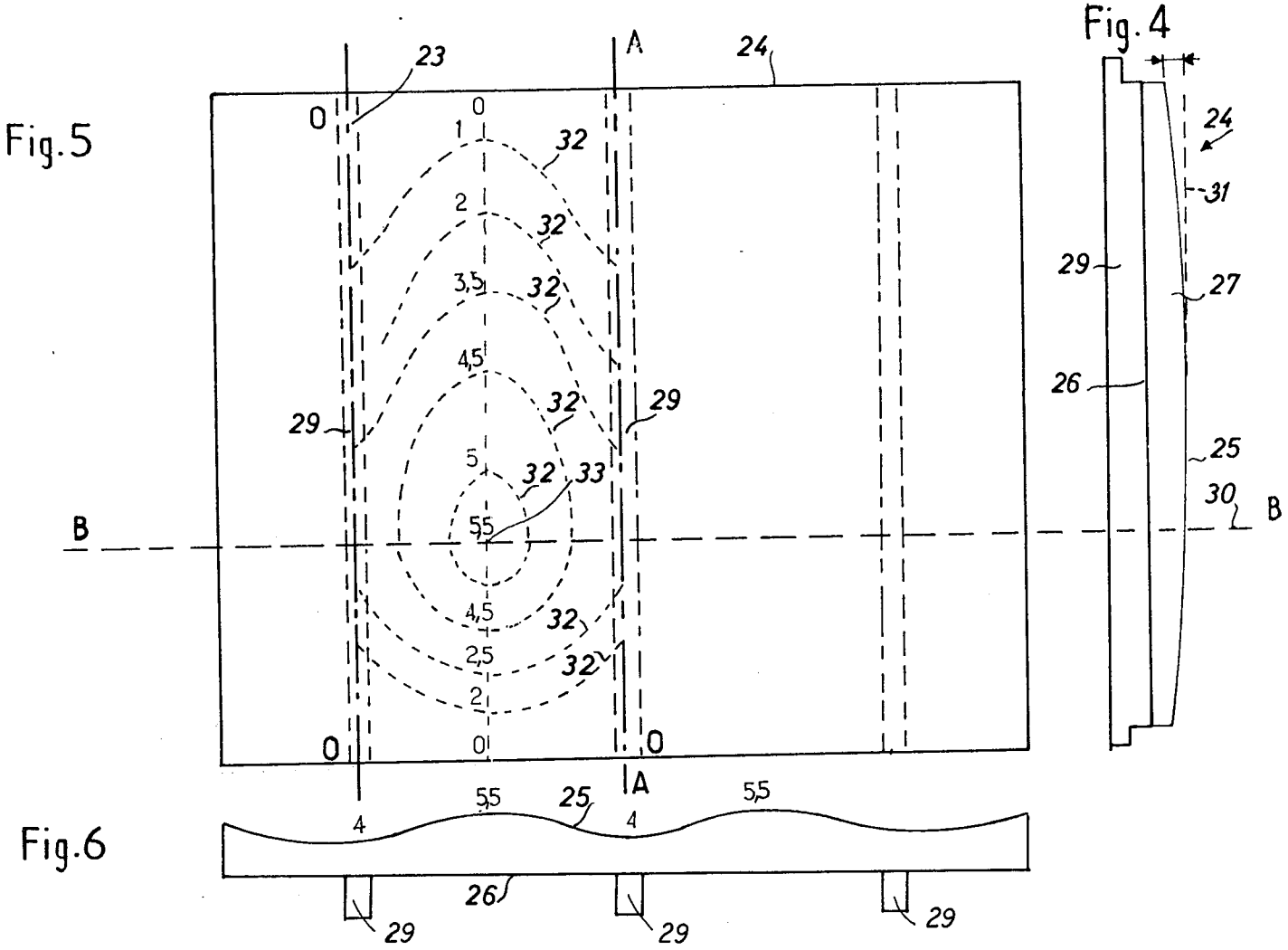
FIG. 5 is a rear elevational view of the panel of FIG. 4.
FIG. 6 is a horizontal sectional view of the panel of FIG. 4.

With reference to FIGS. 4, 5 and 6, panel 24 comprises a front casting wall 25 and a rear wall 26 between which is disposed, as disclosed before, a layer 27 of polyurethane of high density.

The rear wall 26 is planar and bears against vertical posts 29 of a conventional framework.

The front casting wall 25 is non-planar and is initially deformed or curved in two directions to compensate for the bending of the framework and that of the panel 24. Hence, instead of being planar as in the previous embodiment, the front wall is bowed or cambered in two directions to compensate for deflection of the framework and for deflection of the panel under the force of the cast concrete.

The curvature of wall 25 to compensate for the bending of the framework is evident in FIG. 4 which is a vertical section taken through a post 29 of the framework (along line A—A in FIG. 5). As seen in this section, the casting wall 25 has a camber which is a maximum at level 30 at one-third of the height of the panel 24. At the top of the panel the spacing of the casting face 25 from a vertical line 31 tangent to the panel 24 at level 30 is about 4mm (for a panel of a height of 2.6m).

The camber of curvature to compensate for the bending of the panel 24 between the vertical posts 29 of the framework appears in FIG. 5 in which there is shown in dotted outline contours or curves of equal level 32 with respect to a plane passing through the upper and lower edges of the panel. It is noted that at the point 33 situated midway between two successive posts 29 and at one third of the height of the panel, the camber is at a maximum of 5.5 (for a spacing between posts of 1m). FIG. 6 is a horizontal section taken on line B-B in FIG. 5 at one third of the height of the panel to permit better viewing of the form of the camber.

Figure 7:
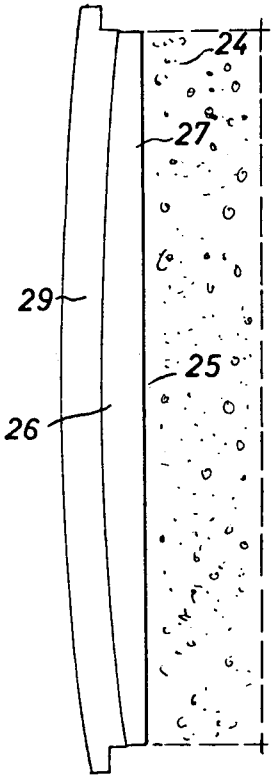
FIG. 7 is a vertical section of the panel shown in FIG. 4, when it is subjected to the pressure of the concrete.

Thus, under the pressure of the concrete, the bending of the panel 24 and of the framework are exactly compensated by the initial curvature of the casting face 24 which at the time of casting presents a casting surface which is absolutely planar as seen in FIG. 7.

It is to be noted that the initial curvature of the casting face 25 can be obtained at the time of formation of the panel by the substantial pressure exerted by the polyurethane during the polymerization. It suffices to provide a mold having a molding surface of complementary form to that of the desired non-planar casting face and to employ the pressure of the polymerization of the polyurethane to produce the curvature of plate 25 as shown in FIGS. 4–6.

Of course, it is possible to compensate in analogous manner to that preceedingly described, the bending of the panel and of the framework in the embodiment shown in FIGS. 2 and 3. By reason of the effect of the horizontal reinforcement obtained by the folds of ribs 9, the initial non-planar shape of plate 7 to compensate the deflection of the panel 6 between the posts 18 is in the form of a series of vertical undulations 34 shown in dotted lines in FIG. 2 rather than the smooth camber as in FIG. 4.

In the embodiment of FIGS. 2 and 3 where, as shown, the distribution of the ribs 9 takes into account the distribution of the pressure exerted on the concrete, i.e. the ribs are more closely spaced towards the base of the panel, the maximum amplitude of the undulations 34 is substantially constant.

What is claimed is:

1. A panel for casting concrete comprising a front casting wall of steel sheet, a rear wall of steel sheet, said front casting wall facing said rear wall and being spaced therefrom, and a layer of expanded rigid polyurethane foam of high density cast in situ between said walls and joining said walls together, the mechanical properties of the cast foam being such that the panel behaves under the load of the concrete as a beam, said mechanical properties being such that:

the polyurethane layer has a sufficient rigidity to prevent relative displacement of said two walls and to resist the shear-tensile forces and as a consequence has a density of at least 200kg/m$^3$;

said front casting wall has a thickness of at least 2.5mm for resisting the tensile forces applied thereto by bending of the panel, said rear wall has a thickness of at least 2.5mm for resisting the compression forces applied thereto by bending of the panel, the adherence of the polyurethane layer with the walls being sufficient to resist the shear-tensile forces and being obtained solely due to the properties of adherence of the polyurethane after polymerization in situ between the two walls.

2. A panel as claimed in claim 1 adapted for being supported on a framework including vertical posts at spaced intervals, said casting wall being non-planar and having an initial shape to compensate for deflection of the panel and of the framework under the pressure of the concrete in order to obtain a planar cast face on the concrete.

3. A panel as claimed in claim 2 wherein said rear wall is planar, said shape of the front wall including a camber extending from top to bottom and widthwise from one post to the next, the camber having a summit situated midway between the posts and at a height equal to one third that of the panel.

4. A panel as claimed in claim 1 wherein said rear wall includes a plurality of horizontal parallel folds at spaced intervals.

5. A panel as claimed in claim 4 wherein said front wall has a face which is initially non-planar to compensate for deformation of the panel under the force of the cast concrete, said front wall comprising a series of vertical undulations having maximum amplitude situated midway between two successive folds of the rear wall and whose minimum amplitude is situated at said folds.

6. A panel as claimed in claim 4 in combination with a support frame, said folds on the rear wall being tapered in a direction away from the front wall and having rear bearing surfaces, said support frame for the panel including means for contacting said rear bearing surfaces of the rear wall.

7. The combination as claimed in claim 6 further comprising means for vertically adjusting the frame and the panel therewith.

* * * * *